US010563526B2

(12) United States Patent
Kang et al.

(10) Patent No.: US 10,563,526 B2
(45) Date of Patent: Feb. 18, 2020

(54) TURBINE APPARATUS

(71) Applicant: HANWHA AEROSPACE CO., LTD, Changwon-si (KR)

(72) Inventors: Sung Jin Kang, Changwon-si (KR); Jae Youl Her, Changwon-si (KR)

(73) Assignee: HANWHA AEROSPACE CO., LTD., Changwon-si (KR)

( * ) Notice: Subject to any disclaimer, the term of this patent is extended or adjusted under 35 U.S.C. 154(b) by 269 days.

(21) Appl. No.: 15/531,050

(22) PCT Filed: Nov. 26, 2015

(86) PCT No.: PCT/KR2015/012748
§ 371 (c)(1),
(2) Date: May 26, 2017

(87) PCT Pub. No.: WO2016/085260
PCT Pub. Date: Jun. 2, 2016

(65) Prior Publication Data

US 2017/0328226 A1 Nov. 16, 2017

(30) Foreign Application Priority Data

Nov. 27, 2014 (KR) ..... 10-2014-0167820

(51) Int. Cl.
*F01D 5/32* (2006.01)
*F01D 5/02* (2006.01)
*F01D 5/30* (2006.01)

(52) U.S. Cl.
CPC ..... *F01D 5/326* (2013.01); *F01D 5/02* (2013.01); *F01D 5/3015* (2013.01); *F01D 5/32* (2013.01);
(Continued)

(58) Field of Classification Search
CPC ..... F01D 5/30; F01D 5/3007; F01D 5/3015; F01D 5/3069; F01D 5/3076; F01D 5/32; F01D 5/323; F01D 5/326
See application file for complete search history.

(56) References Cited

U.S. PATENT DOCUMENTS 2,985,426 A * 5/1961 Hunter ..... F01D 5/06 416/193 A
3,644,058 A * 2/1972 Barnabei ..... F01D 5/081 416/95
(Continued)

FOREIGN PATENT DOCUMENTS

JP 11-247616 A 9/1999
JP 2007-247406 A 9/2007
(Continued)

OTHER PUBLICATIONS

International Search Report (PCT/ISA/210) dated Jan. 25, 2016 issued in International Application No. PCT/KR2015/012748.
(Continued)

*Primary Examiner* — Kenneth J Hansen
*Assistant Examiner* — Maranatha Boardman
(74) *Attorney, Agent, or Firm* — Sughrue Mion, PLLC

(57) ABSTRACT

According to an aspect of the present invention, a turbine apparatus includes a shaft; a turbine disk provided on the shaft and having a plurality of protrusions protruding in a direction of the shaft; blades provided on the turbine disk; a support plate provided on the turbine disk and having a plurality of latching portions engaged with the plurality of protrusions; a plurality of first fixing blocks located between the plurality of latching portions; and a second fixing block located between the plurality of protrusions and fixed to the plurality of first fixing blocks, wherein a width of a space where the second fixing block is located, from among spaces between the plurality of protrusions, is less than a width of
(Continued)

a space where the plurality of first fixing blocks are located, from among spaces between the plurality of latching portions.

7 Claims, 4 Drawing Sheets

(52) U.S. Cl.
CPC ..... *F05D 2220/32* (2013.01); *F05D 2240/24* (2013.01); *F05D 2260/30* (2013.01)

(56) References Cited

U.S. PATENT DOCUMENTS 3,728,042 A * 4/1973 Hugoson ..... F01D 5/081 416/220 R
3,768,924 A * 10/1973 Corsmeier ..... F01D 5/081 416/95
4,019,833 A 4/1977 Gale
4,846,628 A * 7/1989 Antonellis ..... F01D 5/3015 416/220 R
5,018,943 A * 5/1991 Corsmeier ..... F01D 5/027 416/144
5,232,335 A 8/1993 Narayana et al.
5,318,405 A 6/1994 Meade et al.
5,320,488 A 6/1994 Meade et al.
5,472,313 A 12/1995 Quinones et al.
6,488,473 B1 12/2002 Lee et al.
6,494,684 B1 * 12/2002 Wagner ..... F01D 5/3015 403/278
7,040,866 B2 5/2006 Gagner
7,134,843 B2 * 11/2006 Lardellier ..... F01D 5/00 416/204 R
7,458,769 B2 * 12/2008 Forgue ..... F01D 5/26 415/119
7,686,585 B2 * 3/2010 Buisson ..... F01D 5/326 416/193 A
8,192,167 B2 * 6/2012 Helmis ..... F01D 5/3015 416/204 R
8,800,133 B2 8/2014 Caprario et al.
9,033,666 B2 * 5/2015 Bosco ..... F01D 5/081 416/96 R
9,249,676 B2 * 2/2016 Antonellis ..... F01D 5/3015
9,347,325 B2 * 5/2016 Faulder ..... F01D 5/22
2006/0018757 A1 * 1/2006 Wagner ..... F01D 5/3015 416/220 R
2006/0088419 A1 * 4/2006 Hermiston ..... F01D 5/3015 416/220 R
2009/0022593 A1 * 1/2009 Oka ..... F01D 5/3015 416/220 R
2013/0224030 A1 8/2013 Kumura et al.
2013/0323067 A1 12/2013 Antonellis et al.
2014/0023509 A1 1/2014 Burt et al.
2014/0178119 A1 6/2014 Shinohara et al.
2015/0369062 A1 12/2015 Tanaka

FOREIGN PATENT DOCUMENTS

JP 2013-36387 A 2/2013
JP 2013-181431 A 9/2013
JP 2014-185552 A 10/2014

OTHER PUBLICATIONS

Written Opinion (PCT/ISA/237) dated Jan. 25, 2016 issued in International Application No. PCT/KR2015/012748.

* cited by examiner

TURBINE APPARATUS

TECHNICAL FIELD

The present invention relates to a turbine apparatus.

BACKGROUND ART

A turbine apparatus is an apparatus that converts the energy of a fluid such as water, gas, or steam into useful work.

Particularly, in a gas turbine apparatus, high-temperature, high-pressure gas output from a combustor flows into a turbine apparatus and collides with blades in the turbine apparatus, thereby rotating a turbine output shaft.

Korean Patent Application Publication No. 2009-0076158 discloses a steam turbine having a multi-stage structure. Blades installed in the steam turbine are designed so that sizes thereof gradually increase toward the downstream of the turbine and the blades are supported, and thus, even when steam in the downstream is sufficiently expanded and pressure thereof is reduced, a rotational force in the downstream is almost the same as that in the upstream.

DISCLOSURE

Technical Problem

The main objective according to an aspect of the present invention is to provide a turbine apparatus wherein a support plate may be easily provided on a turbine disk.

Technical Solution

According to an aspect of the present invention, there is provided a turbine apparatus including: a shaft; a turbine disk provided on the shaft and having a plurality of protrusions protruding in a direction of the shaft; blades provided on the turbine disk; a support plate provided on the turbine disk and having a plurality of latching portions engaged with the plurality of protrusions; a plurality of first fixing blocks located between the plurality of latching portions; and a second fixing block located between the plurality of protrusions and fixed to the plurality of first fixing blocks, wherein a width of a space where the second fixing block is located, from among spaces between the plurality of protrusions, is less than a width of a space where the plurality of first fixing blocks are located, from among spaces between the plurality of latching portions.

Advantageous Effects

In a turbine apparatus according to an aspect of the present invention, a support plate for supporting blades can be easily provided on a turbine disk.

BEST MODE

Figure 1:
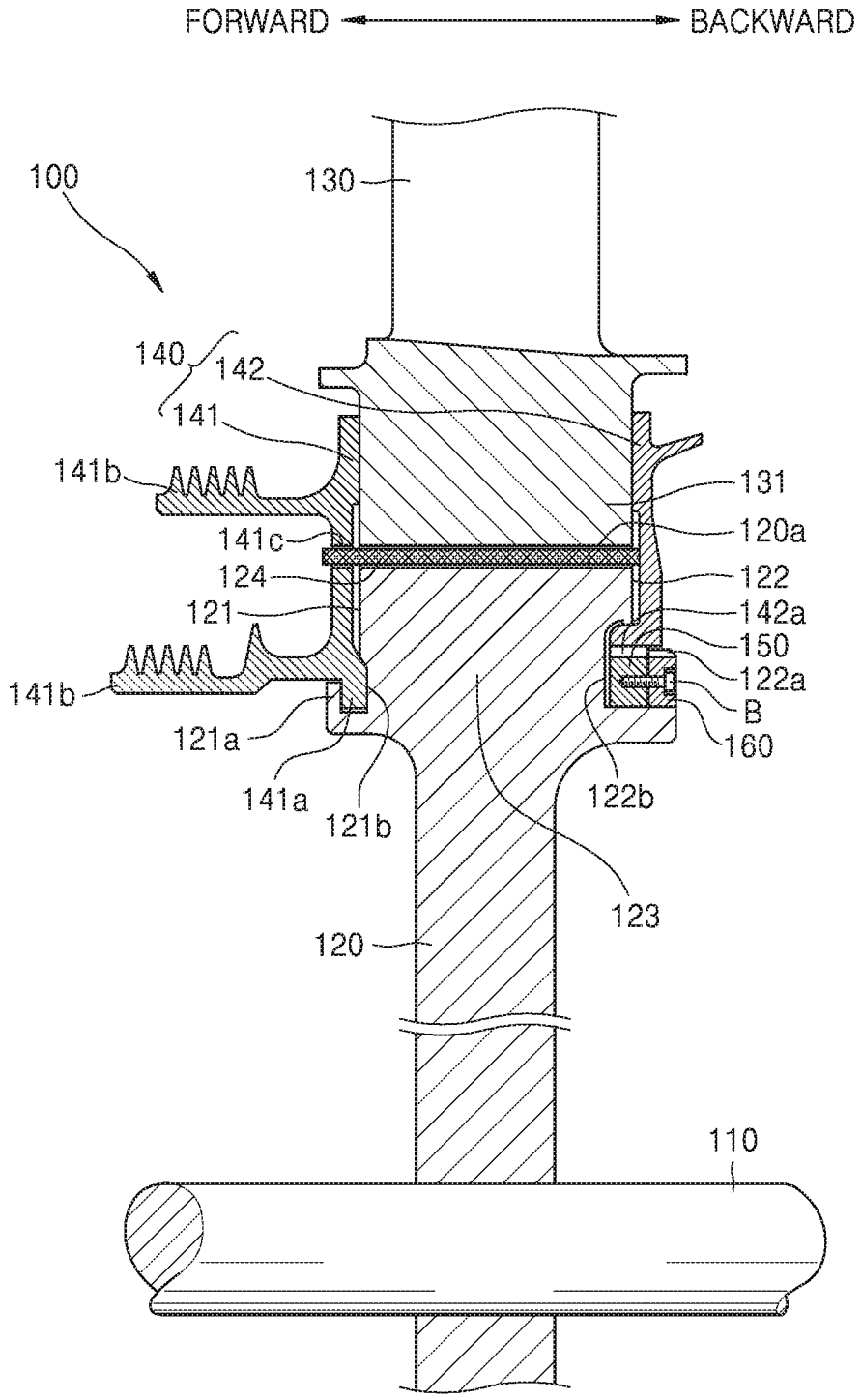
FIG. 1 is a partial cross-sectional view illustrating an inner area of a turbine apparatus according to an embodiment of the present invention.

According to an aspect of the present invention, there is provided a turbine apparatus including: a shaft; a turbine disk provided on the shaft and having a plurality of protrusions protruding in a direction of the shaft; blades provided on the turbine disk; a support plate provided on the turbine disk and having a plurality of latching portions engaged with the plurality of protrusions; a plurality of first fixing blocks located between the plurality of latching portions; and a second fixing block located between the plurality of protrusions and fixed to the plurality of first fixing blocks, wherein a width of a space where the second fixing block is located, from among spaces between the plurality of protrusions, is less than a width of a space where the plurality of first fixing blocks are located, from among spaces between the plurality of latching portions.

Blade mounting portions may be formed on ends of the blades, wherein blade insertion grooves into which the blade mounting portions are inserted in the direction of the shaft to prevent the blades from moving in a radial direction of the shaft are formed in the turbine disk.

Receiving grooves in which the plurality of latching portions are received may be formed in the turbine disk.

At least one first mounting hole may be formed in each of the plurality of first fixing blocks, a second mounting hole may be formed in the second fixing block at a position corresponding to the at least one first mounting hole, and a fixing bolt may be installed at the first mounting hole and the second mounting hole.

A bolt head receiving groove in which a head of the fixing bolt is received may be further formed in the second mounting hole.

The support plate may be provided on at least one of a front part and a rear part of the turbine disk in the direction of the shaft.

MODE FOR INVENTION

Reference will now be made in detail to embodiments, examples of which are illustrated in the accompanying drawings. In the drawings, elements having the same configurations are denoted by the same reference numerals, and a repeated explanation thereof will not be given.

Figure 2:
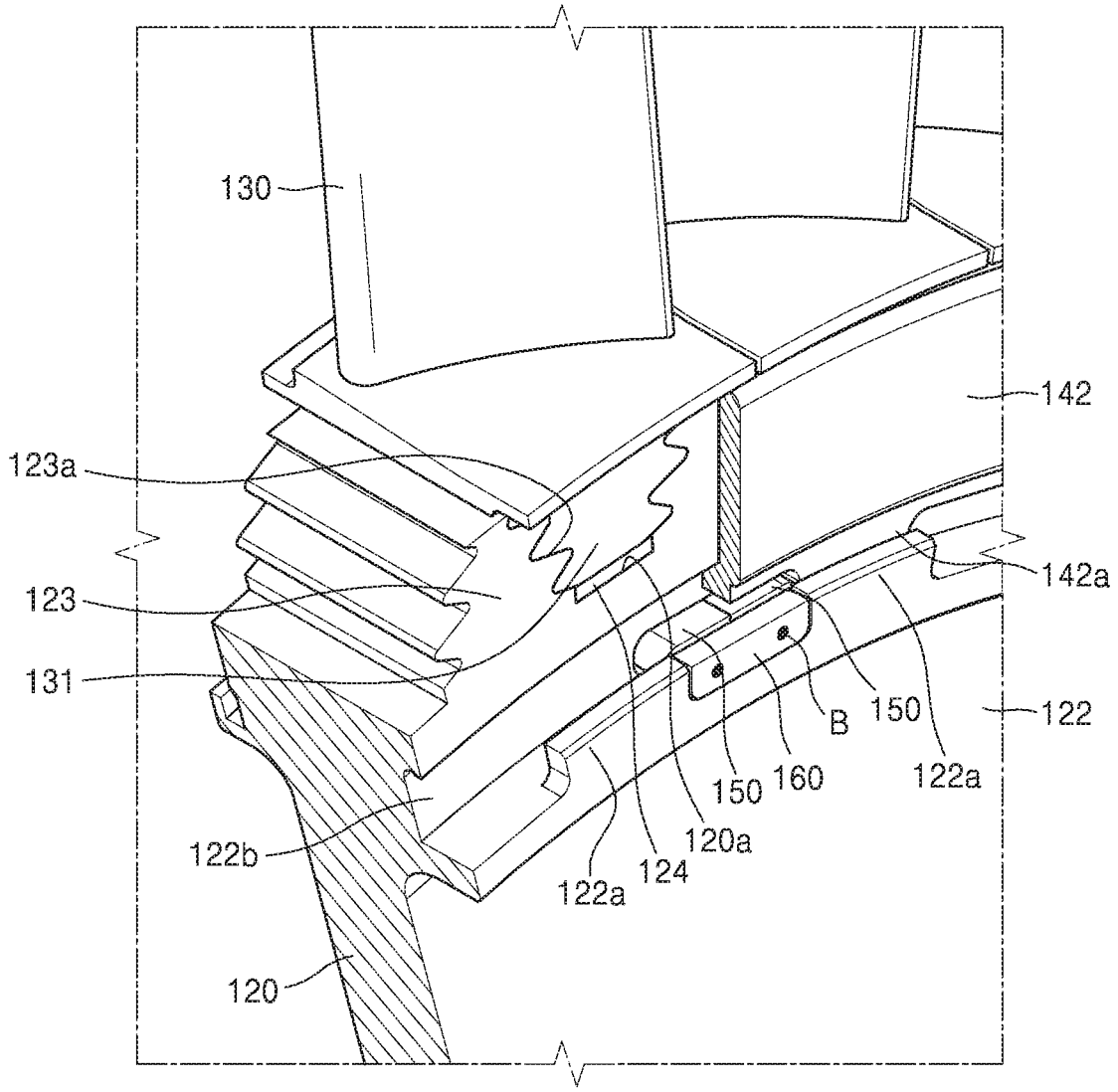
FIG. 2 is a partial cutaway view illustrating a rear support plate provided on a turbine disk according to an embodiment of the present invention.
Figure 3:
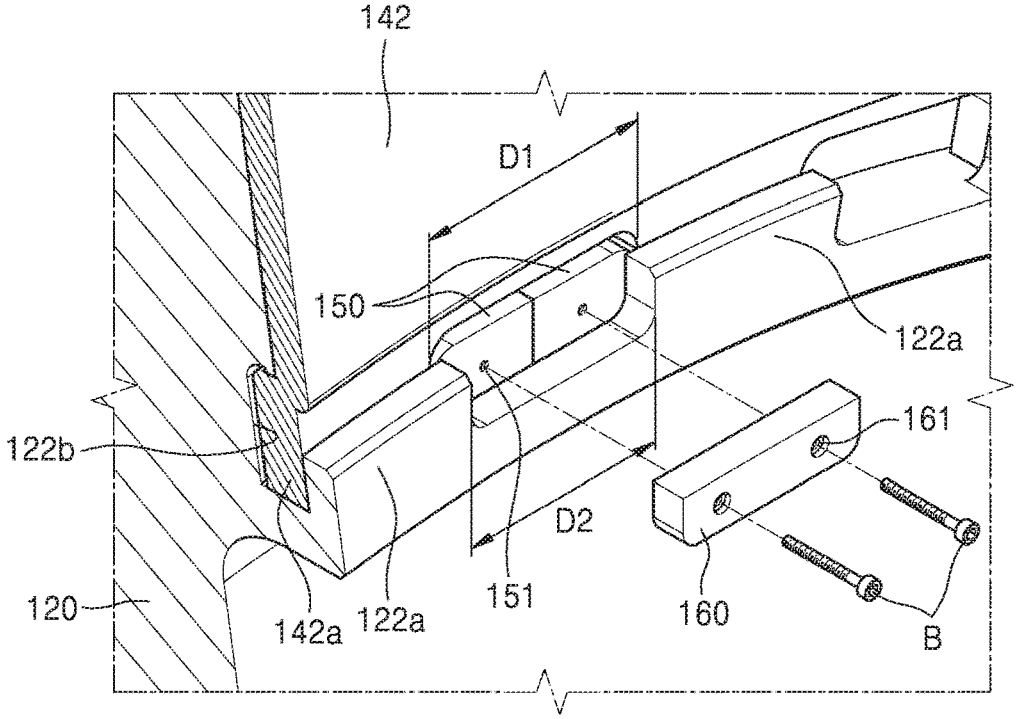
FIG. 3 is a schematic view illustrating first fixing blocks and a second fixing block provided on the rear support plate and the turbine disk according to an embodiment of the present invention.
Figure 4:
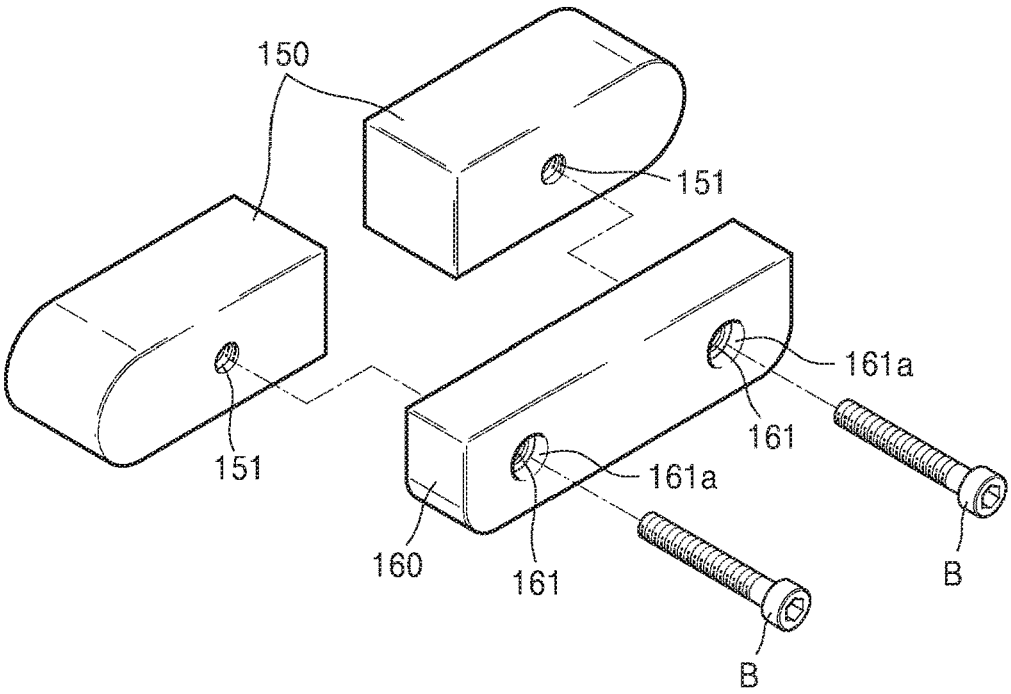
FIG. 4 is an exploded perspective view illustrating the first fixing blocks and the second fixing block according to an embodiment of the present invention.

FIG. 1 is a partial cross-sectional view illustrating an inner area of a turbine apparatus according to an embodiment of the present invention. FIG. 2 is a partial cutaway view illustrating a rear support plate provided on a turbine disk according to an embodiment of the present invention. Also, FIG. 3 is a schematic view illustrating first fixing blocks and a second fixing block provided on the rear support plate and the turbine disk according to an embodiment of the present invention. FIG. 4 is an exploded perspective view illustrating the first fixing blocks and the second fixing block according to an embodiment of the present invention.

As shown in FIGS. 1 through 4, a turbine apparatus 100 includes a shaft 110, a turbine disk 120, blades 130, a support plate 140, first fixing blocks 150, and a second fixing block 160.

The shaft 110, which is an output shaft of the turbine apparatus 100, rotates by receiving a rotational force from the blades 130.

The turbine disk 120 is provided on the shaft 110 and has a shape resembling a flat circular plate.

The turbine disk 120 includes a front part 121, a rear part 122, an outer circumferential part 123, and a fixing bar 124.

The support plate 140 is provided on each of the front part 121 and the rear part 122.

A plurality of protrusions 121*a* project in a direction of the shaft 110 from the front part 121 and are spaced apart from one another at predetermined intervals. Receiving grooves 121*b* are formed inside the protrusions 121*a*.

A plurality of protrusions 122*a* project in the direction of the shaft 110 from the rear part 122 and are spaced apart from one another at predetermined intervals. Receiving grooves 122*b* are formed inside the protrusions 122*a*.

Blade mounting grooves 123*a* are formed in the outer circumferential part 123, and blade mounting portions 131 are inserted in the direction of the shaft 110 into the blade mounting grooves 123*a* so that the blades 130 are prevented from moving in a radial direction of the shaft 110. To this end, the blade mounting grooves 123*a* may be formed to have any of various shapes having concave and convex portions, for example, sawtooth shapes, wave shapes, gear teeth shapes, spline shapes, or dove tail shapes.

A fixing bar support groove 120*a* is formed in the direction of the shaft 110 in the turbine disk 120 and the fixing bar 124 is inserted into the fixing bar support groove 120*a* so that rotation of a front support plate 141 is prevented.

The blades 130, which are members for generating a rotational force by colliding with gas, are arranged at predetermined intervals in a circumferential direction of the turbine disk 120.

The blade mounting portions 131 are respectively formed on ends of the blades 130. The blade mounting portions 131 have shapes corresponding to shapes of the blade mounting grooves 123*a*, as shown in FIG. 2, so that the blade mounting portions 131 are inserted into the blade mounting grooves 123*a*. That is, during an assembly process, the blade mounting portions 131 are inserted into the blade mounting grooves 123*a* in the direction of the shaft 110.

The support plate 141 includes the front support plate 141 and a rear support plate 142.

The front support plate 141 has an annular shape with a predetermined width, is provided in front of the turbine disk 120, and prevents the blades 130 from moving forward. To this end, the front support plate 141 has a size large enough to prevent the blade mounting portions 131 from moving in the direction of the shaft 110.

A plurality of latching portions 141*a* are formed at a lower portion of the front support plate 141 and are engaged with the protrusions 121*a* of the turbine disk 120 when the front support plate 141 is installed to form a bayonet structure. In addition, a sealing portion 141*b* is formed on a front part of the front support plate 141.

A fixing hole 141*c* is formed in the front support plate 141, and the fixing bar 124 is inserted into the fixing hole 141*c* to prevent the front support plate 141 from rotating.

The rear support plate 142 has an annular shape with a predetermined width, is provided behind the turbine disk 120, and prevents the blades 130 from moving backward. To this end, the rear support plate 142 has a size large enough to prevent the blade mounting portions 131 from moving in the direction of the shaft 110.

A plurality of latching portions 142*a* are formed at a lower portion of the rear support plate 142, and are engaged with the protrusions 122*a* of the turbine disk 120 when the rear support plate 142 is installed to form a bayonet structure.

The first fixing blocks 150, a number of which is 2, are located in a space between the latching portions 142*a* of the rear support plate 142.

Although a plurality of the latching portions 142*a* are formed on the rear support plate 142 and the first fixing blocks 150 are located in some of spaces between the latching portions 142*a* according to the present embodiment, the present invention is not limited thereto. That is, according to the present invention, the first fixing blocks 150 may be located in all of the spaces between the latching portions 142*a* of the rear support plate 142.

At least one first mounting hole 151 is formed in each of the first fixing blocks 150, and a screw thread is formed on an inner circumferential surface of the first mounting hole 151.

The second fixing block 160 is located between the protrusions 122*a* of the turbine disk 120, and is fixed to the first fixing blocks 150.

A second mounting hole 161 is formed in the second fixing block 160 at a position corresponding to the first mounting hole 151, and a screw thread is formed on an inner circumferential surface of the second mounting hole 161. As shown in FIGS. 3 and 4, during installation, a fixing bolt B passes through the second mounting hole 161 and is inserted into the first mounting hole 151.

Although the screw thread is formed on the inner circumferential surface of the second mounting hole 161 according to the present embodiment, the present invention is not limited thereto. That is, no screw thread may be formed on the inner circumferential surface of the second mounting hole 161 according to the present invention.

Also, a bolt head receiving groove 161*a* that is connected to the second mounting hole 161 and allows a head of the fixing bolt B to be received therein is formed in the second fixing block 160.

Although the bolt head receiving groove 161*a* is formed in the second fixing block 160 according to the present embodiment, the present invention is not limited thereto. That is, no bolt head receiving groove 161*a* may be formed in the second fixing block 160 according to the present invention.

Although the first fixing blocks 150 and the second fixing block 160 are fixed to each other by using the fixing bolt B according to the present embodiment, the present invention is not limited thereto. That is, according to the present invention, the first fixing blocks 150 and the second fixing block 160 may be fixed to each other by using another fastening means. For example, the first fixing blocks 150 and the second fixing block 160 may be fixed to each other by using any of various fastening means such as an adhesive, soldering, or hooks.

Figure 5:
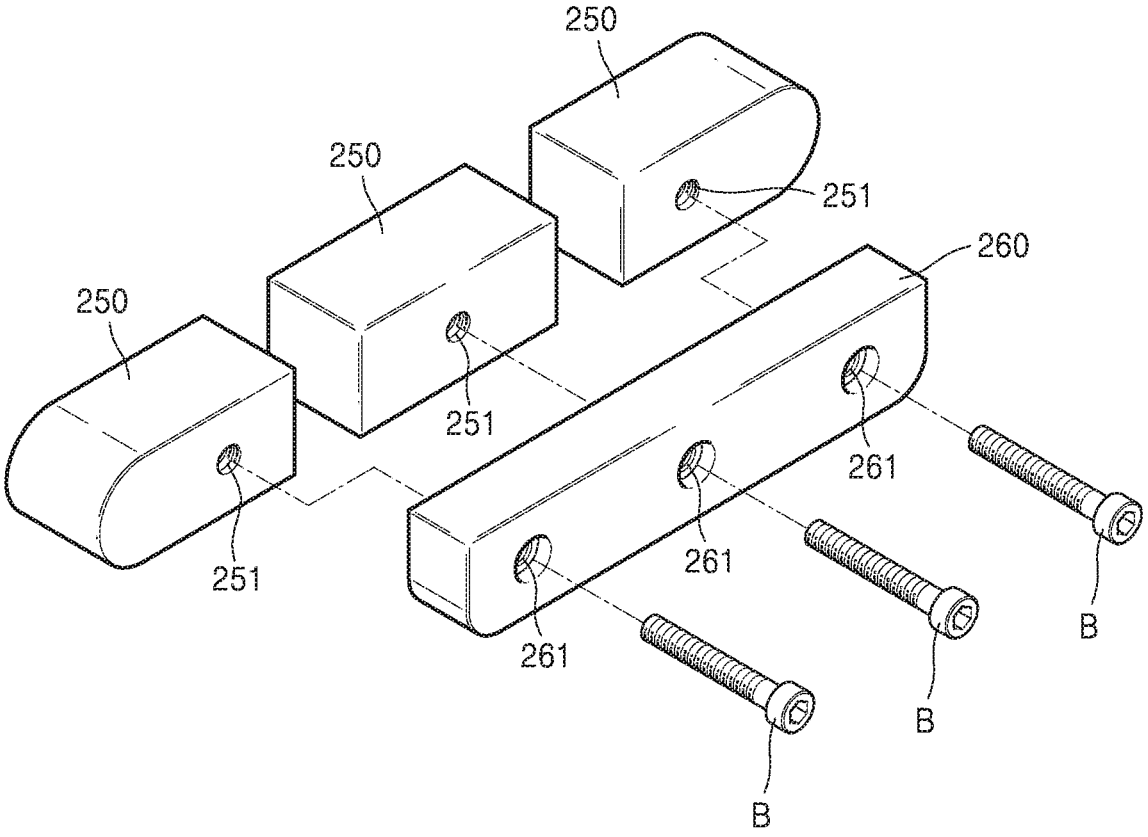
FIG. 5 is an exploded perspective view illustrating the first fixing blocks and the second fixing block according to a modification of an embodiment of the present invention.

Although the number of the first fixing blocks 150 is 2 according to the present embodiment, the present invention is not limited thereto. That is, according to the present invention, there is no particular limitation on the number of the first fixing blocks 150. For example, the number of the first fixing blocks may be 3, 4, or 5. FIG. 5 illustrates a case where the number of the first fixing blocks 250 is 3. In FIG. 5, the number of first fixing blocks 250 is 3, first mounting holes 251 each having a screw formed on an inner circumferential surface thereof are respectively formed in the first fixing blocks 250, second mounting holes 261 are formed in second fixing blocks 260 at a position corresponding to the first mounting holes 251, and during installation, three fixing bolts B pass through the second mounting holes 261 and are respectively fixedly inserted into the first mounting hoes 251.

As shown in FIG. 3, a width D2 of a space where the second fixing block 160 is located, from among spaces between the protrusions 122*a*, is less than a width D1 of a space where the first fixing blocks 150 are located, from among spaces between the latching portions 142*a*. Since sizes are limited as such, after the support plate 140 is completely installed, the first fixing blocks 150 are prevented from moving in the direction of the shaft 110 by being blocked by the protrusions 122*a*.

A process of installing the blades 130 and the support plate 140 on the turbine disk 120 of the turbine apparatus 100 according to an embodiment will now be explained.

First, an operator inserts the blade mounting portions 131 in the direction of the shaft 110 into the blade mounting grooves 123*a* of the outer circumferential part 123 from among parts of the turbine disk 120. In this case, the blades 130 are prevented from moving in the radial direction of the shaft 110 due to a coupling structure between the blade mounting portions 131 and the blade mounting grooves 123*a*.

Next, the operator installs the front support plate 141 on the front part 121 from among the parts of the turbine disk 120. In detail, the operator locates the front support plate 141 on the front part 121 of the turbine disk 120 so that the latching portions 141*a* are located in the receiving grooves 121*b*, and then rotates the front support plate 141 so that the plurality of latching portions 141*a* are engaged with the protrusions 121*a* of the turbine disk 20 to form a bayonet coupling. In this case, due to the front support plate 141, the blade mounting portions 131 are prevented from moving forward in the direction of the shaft 110.

Next, the operator inserts the fixing bar 124 into the fixing bar support groove 120*a* from the rear part 122 of the turbine disk 120 and allows the fixing bar 124 to be inserted into the fixing hole 141*c* of the front support plate 141. In this case, the front support plate 141 is prevented from rotating, and the bayonet coupling between the front support plate 141 and the turbine disk 120 is firmly maintained.

Next, the operator provides the rear support plate 142 on the rear part 122 from among the parts of the turbine disk 120. In detail, the operator 142*a* locates the rear support plate 142 on the rear part 122 of the turbine disk 120 so that the latching portions 142*a* are inserted into the receiving grooves 122*b*, and then rotates the rear support plate 142 so that the plurality of latching portions 142*a* are engaged with the protrusions 122*a* of the turbine disk 120 to form the bayonet coupling. In this case, due to the rear support plate 142, the blade mounting portions 131 are prevented from moving backward in the direction of the shaft 110.

Next, the operator pushes the first fixing blocks 150 one by one into a space between the latching portions 142*a* of the turbine disk 120, and sets the first fixing blocks 150 to be aligned as shown in FIG. 3. Next, the operator locates the second fixing block 160 in a space between the protrusions 122*a* and screws the fixing bolt B through the second mounting hole 161 into the first mounting hole 151 so that the first fixing blocks 150 and the second fixing block 160 are fixed to each other. In this case, the rear support plate 142 is prevented from rotating, and the bayonet coupling between the rear support plate 142 and the turbine disk 120 is firmly maintained.

As described above, according to an embodiment of the present invention, since the rear support plate 142 may be prevented from rotating by using the first fixing blocks 150 and the second fixing block 160, the rear support plate 142 may be easily fixed. Accordingly, the number of assembly processes and an assembly time of the turbine apparatus 100 may be reduced, thereby reducing the manufacturing costs.

Although the first fixing blocks 150 and the second fixing block 160 are used only to prevent the rear support plate 142 from rotating according to the present embodiment, the present invention is not limited thereto. That is, according to the present invention, the first fixing blocks 150 and the second fixing block 160 may also be used to prevent the front support plate 141 from rotating.

While aspects of the present invention have been particularly shown and described with reference to the embodiments thereof, they are provided for the purposes of illustration and it will be understood by one of ordinary skill in the art that various modifications and equivalent other embodiments can be made from the present invention. Accordingly, the true technical scope of the present invention is defined by the appended claims.

INDUSTRIAL APPLICABILITY

According to an aspect of the present invention, the present invention may be applied to industries for manufacturing or using turbine apparatuses.

The invention claimed is:

1. A turbine apparatus comprising:

a shaft;

a turbine disk provided on the shaft and having a plurality of protrusions protruding in an axial direction of the shaft;

blades provided on the turbine disk;

a support plate provided on the turbine disk and having a plurality of latching portions engaged with the plurality of protrusions, two adjacent latching portions of the plurality of latching portions forming a space;

a plurality of first fixing blocks located and aligned in a line in each space of the plurality of latching portions; and a second fixing block located between the plurality of protrusions and fixed to the plurality of first fixing blocks, the plurality of first fixing blocks being axially spaced with respect to the second fixing block, wherein a width of a space where the second fixing block is located, from among spaces between the plurality of protrusions, is less than a width of a space where the plurality of first fixing blocks are located, from among spaces between the plurality of latching portions, and wherein:

each of the plurality of first fixing blocks comprises a first mounting hole, the second fixing block comprises at least one second mounting hole provided at a position corresponding to the first mounting hole, and a fixing bolt is installed at the first mounting hole and the at least one second mounting hole.

2. The turbine apparatus of claim 1, wherein blade mounting portions are formed on ends of the blades, wherein blade insertion grooves into which the blade mounting portions are inserted in the axial direction of the shaft to prevent the blades from moving in a radial direction of the shaft are formed in the turbine disk.

3. The turbine apparatus of claim 1, wherein receiving grooves in which the plurality of latching portions are received are formed in the turbine disk.

4. The turbine apparatus of claim 1, wherein a bolt head receiving groove in which a head of the fixing bolt is received is further formed in the second mounting hole.

5. The turbine apparatus of claim 1, wherein the support plate is provided on at least one of a front part and a rear part of the turbine disk in the axial direction of the shaft.

6. The turbine apparatus of claim 1, wherein the plurality of first fixing blocks in each space are aligned in a circumferential direction of the turbine disk.

7. The turbine apparatus of claim 1, wherein a number of the at least one second mounting hole corresponds to a number of the plurality of first fixing blocks.

* * * * *